US007073962B2

(12) United States Patent
Sawai

(10) Patent No.: US 7,073,962 B2
(45) Date of Patent: Jul. 11, 2006

(54) THERMAL-TRANSFER PRINTER

(75) Inventor: Kunio Sawai, Daito (JP)

(73) Assignee: Funai Electric Co., Daito (JP)

( * ) Notice: Subject to any disclaimer, the term of this patent is extended or adjusted under 35 U.S.C. 154(b) by 64 days.

(21) Appl. No.: 10/900,392

(22) Filed: Jul. 28, 2004

(65) Prior Publication Data

US 2005/0063752 A1 Mar. 24, 2005

(30) Foreign Application Priority Data

Jul. 28, 2003 (JP) ..... 2003-202293

(51) Int. Cl.
*B41J 2/315* (2006.01)

(52) U.S. Cl. ..... 400/120.01; 400/120.17

(58) Field of Classification Search ..... 400/120.01, 400/120.16, 120.17; 347/171, 173, 197, 347/198

See application file for complete search history.

(56) References Cited

U.S. PATENT DOCUMENTS 5,775,820 A * 7/1998 Sugimoto et al. ..... 400/120.16

2003/0049065 A1* 3/2003 Barrus et al. ..... 400/223

FOREIGN PATENT DOCUMENTS

| | | |
|---|---|---|
| JP | 2-160558 | 6/1990 |
| JP | 3-049961 | 3/1991 |
| JP | 9-071022 | 3/1997 |

* cited by examiner

*Primary Examiner*—Andrew H. Hirshfeld
*Assistant Examiner*—Kevin D. Williams
(74) *Attorney, Agent, or Firm*—Crowell & Moring LLP

(57) ABSTRACT

The thermal-transfer printer includes: a pair of head attaching arms 12 having fitting holes 12*c* respectively inserted with support shafts 9 and having center lines inclined to axis lines of the supporting shafts 9 by a predetermined inclination angle; and supporting shaft attaching portions 12*b* being bent by bending lines 12*d* that intersects with a line connecting the fitting holes 12*c* and a printing position of a thermal head 11 relative to a sheet 100. The fitting hole 12*c* of respective supporting shaft attaching portion 12*b* are attached to the supporting shafts 9 in a state of being elastically bent in directions opposed to each other such that predetermined inclination angles of the supporting shafts 9 of center lines of the fitting hole 12*c* of the supporting shaft attaching portion 12*b* relative to axis lines of the supporting shafts 9 are reduced.

9 Claims, 8 Drawing Sheets

THERMAL-TRANSFER PRINTER

BACKGROUND OF THE INVENTION

1. Field of the Invention

The present invention relates to a thermal-transfer printer, particularly relates to a thermal-transfer printer having a thermal head for thermally transferring ink onto a sheet.

2. Description of the Related Art

Conventionally, there is known a thermal-transfer printer having a thermal head for thermally transferring ink onto a sheet.

In JP-A-2-160558, there is disclosed a thermal-transfer printer for pressing a platen roller to a thermal head by pivoting a positioning member for supporting the platen roller centering on a predetermined axis.

In JP-A-3-049961, there is disclosed a thermal-transfer printer for restraining a thermal head from producing a positional shift in a longitudinal direction by providing an attaching plate with a compression spring for restraining the attaching plate attached with the thermal head from moving in a longitudinal direction of the thermal head.

In JP-A-9-071022, there is disclosed a thermal-transfer printer for restraining a thermal head from moving in a direction along a shaft by bringing a supporting piece into contact with a restricting member even when a force in the direction along the shaft is exerted to the thermal head by providing the restricting members to both sides of the supporting piece for attaching the thermal head to the shaft.

FIG. 9 is a perspective view showing a overall structure of a thermal-transfer printer having a thermal head for thermally transferring ink onto a sheet according to an example of a prior art. Further, FIG. 9 shows a state of removing an ink cartridge of the thermal-transfer printer. FIG. 10 is a top view of the thermal-transfer printer according to the example of the prior art shown in FIG. 9. FIG. 11 and FIG. 12 are sectional views taken along XI—XI line shown in FIG. 10. FIG. 13 is a disassembled perspective view showing a structure of a heating portion of the thermal-transfer printer according to the example of the prior art shown in FIG. 9. FIG. 14 is an enlarged sectional view showing a structure of attaching a head attaching arm of the thermal-transfer printer according to the example of the prior art shown in FIG. 9 to a supporting shaft. First, an explanation will be given of a structure of the thermal-transfer printer having the thermal head according to the example of the prior art.

As shown in FIG. 9, a main body frame 101 is provided in the thermal-transfer printer having the thermal head according to the example of the prior art. A first conveying roller 102 for conveying a sheet 200 (refer to FIG. 10) is provided on this side of a front side of the main body frame 101. A holding roller 103 for restraining the sheet 200 from floating up from the first conveying roller 102 is provided on an upper side of the first conveying roller 102. Further, a second conveying roller 104 for conveying the sheet 200 is provided on a rear side of the first conveying roller 102. A holding roller 105 for restraining the sheet 200 from floating up from the second conveying roller 104 is provided on an upper side of the second conveying roller 104.

A platen roller 106 for conveying the sheet 200 is provided on a rear side of the second conveying roller 104. Further, an ink cartridge 107 is attached to a central portion of the main body frame 101 as shown in FIG. 10 through FIG. 12. As shown in FIG. 11, an ink sheet 107*a* adhered with ink for transferring onto the sheet 200 is contained in the ink cartridge 107. The ink of the ink sheet 107*a* is constituted by three colors of inks of C (cyan), M (magenta) Y (yellow).

Further, as shown in FIG. 9 and FIG. 11, a heating portion 108 for thermally transferring the ink of the ink sheet 107*a* onto the sheet 200 is provided on a depth side of the central portion of the main body frame 101. The heating portion 108 is pivotally supported by a pair of supporting shafts 109. Further, the heating portion 108 is urged in a direction of pivoting upwardly by a torsion coil spring 110 mounted to one of the supporting shafts 109. Further, as shown in FIG. 13, the heating portion 108 is constituted by a thermal head 111, a pair of head attaching arms 112, a pair of bearing members 123, a pair of head supporting arms 113, a compression coil spring 114 and a heat radiating plate 115. The thermal head 111 is provided for thermally transferring the ink of the ink sheet 107*a* onto the sheet 200 by heating the ink sheet 107*a* contained in the ink cartridge 107 (refer to FIG. 11). Further, as shown in FIG. 13, a pair of spring attaching boss portions 111*a* is provided at an upper portion of the thermal head 111.

The pair of head attaching arms 112 include head attaching portions 112*a* attached with the thermal head 111 and supporting shaft attaching portions 112*b* for supporting the supporting shafts 109. As shown in FIG. 10, the head attaching arm 112 is formed to extend in a direction along a direction of conveying the sheet 200. Further, as shown in FIG. 13, the head attaching portions 112*a* of the head attaching arms 112 are attached with the thermal head 111. Further, a fitting hole 112*c* is provided at the supporting shaft attaching portion 112*b* of the head attaching arm 112. As shown in FIG. 14, a bearing member 123 is attached to the fitting hole 112*c* of the head attaching arm 112. The supporting shaft 109 is inserted into the bearing member 123.

Further, as shown in FIG. 13, the pair of head supporting arms 113 are attached to side faces on outer sides of the head attaching arms 112. A spring pressing portion 113*a* is formed at an upper portion of the head supporting arm 113. Further, a boss portion 113*b* is provided at a side face of one end portion of the head supporting arm 113. Further, a fitting hole 113*c* is provided at other end portion of the head supporting arm 113 at the position in correspondence with the fitting hole 112*c* of the head attaching arm 112. The supporting shaft 109 is inserted into the fitting hole 113*c* of the head supporting arm 113. Thereby, the head supporting arm 113 is pivotally supported by the supporting shaft 109 along with the head attaching arm 112.

Further, the compression coil spring 114 is mounted to the spring attaching boss portion 111*a* of the thermal head 111. An upper portion of the compression coil spring 114 is pressed by the spring pressing portion 113*a* of the head supporting arm 113. The compression coil spring 114 is provided for pressing the thermal head 111 to a side of the platen roller 106 (refer to FIG. 9) by a predetermined pressing force. Further, as shown in FIG. 13, the heat radiating plate 115 is attached to an upper portion of the thermal head 111. The heat radiating plate 115 is provided for radiating heat of the thermal head 111.

Further, a pressing member 116 is provided to be brought into contact with the respective boss portions 113*b* of the pair of head supporting arms 113. The pressing member 116 is constituted by a pair of pressing arms 117 brought into contact with the boss portions 113*b* of the head supporting arms 113, and a connecting member 118 for connecting the pair of pressing arms 117. Further, the pressing member 116 is constituted to pivot by constituting an axis thereof by the connecting member 118. Further, the pressing member 116 is provided to pivot the heating portion 108 in the direction of bringing the thermal head 111 into contact with the ink sheet 107*a* (refer to FIG. 11) by pressing down the boss portion 113*b* of the head supporting arm 113. Further, as shown in FIG. 13, a gear engaging portion 117*a* is formed at one of the pair of pressing arms 117. A drive gear 119 is brought in mesh with the gear engaging portion 117*a* of the pressing arm 117. As shown in FIG. 10, a middle gear 120 is brought in mesh with the drive gear 119 and a drive transmitting gear 121 is brought in mesh with the middle gear 120. A motor side drive gear 122*a* of a motor 122 attached to a side face of the main body frame 101 is brought in mesh with the drive transmitting gear 121.

Next, an explanation will be given of operation of the thermal-transfer printer having the thermal head according to the example of the prior art in reference to FIG. 10 through FIG. 12 and FIG. 14. As the operation of the thermal-transfer printer having the thermal head according to the example of the prior art, as shown in FIG. 11, the sheet 200 is conveyed in an arrow mark D direction in FIG. 11 by rotating the first conveying roller 102 in an arrow mark C direction in FIG. 11. The sheet 200 is conveyed further in the arrow mark D direction in FIG. 11 by rotating the second conveying roller 104 in the arrow mark C direction in FIG. 11. The sheet 200 conveyed by the second conveying roller 104 reaches the platen roller 106.

At this occasion, rotation of the motor side drive gear 122*a* rotated by driving the motor 122 (refer to FIG. 10) is transmitted to the gear engaging portion 117*a* of the pressing arm 117 via the middle gear and the drive gear 119. Thereby, the pressing arm 117 is pivoted in an arrow mark E direction in FIG. 11. When the pressing arm 117 is pivoted in the arrow mark E direction in FIG. 11, the boss portion 113*b* of the head supporting arm 113 is pressed down by the pressing arm 117. Thereby, the heating portion 108 disposed at an escaping position as shown in FIG. 11 is pivoted in an arrow mark F direction by constituting an axis thereof by the supporting shaft 109. When the heating portion 108 is pivoted in the arrow mark F direction in FIG. 11, as shown in FIG. 12, the thermal head 111 of the heating portion 108 is brought into contact with the ink sheet 107*a* of the ink cartridge 107, and the ink sheet 107 and the sheet 200 are pressed to the platen roller 106. Thereby, the ink sheet 107*a* is heated by the thermal head 111 and therefore, ink of one color in three colors of inks of C (cyan), M (magenta) and Y (yellow) of the ink sheet 107*a* is thermally transcribed onto the sheet 200. At this occasion, the thermal head 111 is exerted with a force in a direction along a direction of conveying the sheet 200 from the rotating platen roller 106 (arrow mark D direction in FIG. 12).

Further, the sheet 200 is further conveyed in the arrow mark D direction in FIG. 12 and the ink of the ink sheet 107*a* is thermally transcribed up to a rear end of the sheet 200 by the thermal head 111. When the ink is thermally transcribed up to the rear end of the sheet 200, the sheet 200 is conveyed in an arrow mark H direction in FIG. 12 by rotating the platen roller 106, the second conveying roller 104 and the first conveying roller 102 in an arrow mark G direction in FIG. 12. At this occasion, rotation of the motor side drive gear 122*a* rotated by driving the motor 122 (refer to FIG. 10) is transmitted to the gear engaging portion 117*a* of the pressing arm 117 via the drive transmitting gear 121, the middle gear 120 and the drive gear 119. Thereby, the pressing arm 117 is pivoted in an arrow mark I direction in FIG. 12. In accordance with pivoting the pressing arm 117 in the arrow mark I direction in FIG. 12, the heating portion 108 urged in an upper direction by the torsion coil spring 110 (refer to FIG. 10) is pivoted in an arrow mark J direction in FIG. 12 by constituting an axis thereof by the supporting shaft 109. Thereby, as shown in FIG. 11, the heating portion 108 is moved to the escaping position. Further, the sheet 200 is conveyed in the arrow mark H direction in FIG. 11 up to a vicinity of the first conveying roller 102.

Further, thereafter, by repeating operation similar to the above-described operation twice, remaining two colors of inks of C (cyan), M (magenta) and Y (yellow) are transcribed onto the sheet 200. Thereby, an image is printed on the sheet 200.

In the thermal-transfer printer having the thermal head according to the example of the prior art shown in FIG. 9, dimensions of fitting the supporting shaft 109 and the bearing member 123 are designed such that the heating portion 108 can be pivoted relative to the supporting shaft 109. However, owing to a dimensional error, as shown in FIG. 14, there is brought about a drawback that there is frequently a case of producing a clearance 124 between the bearing member 123 and the supporting shaft 109. Thereby, rattling is brought about between the bearing member 123 and the supporting shaft 109 and therefore, there is brought about a drawback that rattling is caused in the head attaching arm 112 attached with the bearing member 123 relative to the supporting shaft 109. Therefore, rattling is caused in the thermal head 111 attached to the head attaching arm 112 in the direction of conveying the sheet 200 and therefore, there is brought about a drawback that a printing position of the thermal head 111 relative to the sheet 200 is shifted in the direction of conveying the sheet 200. As a result, there occurs a problem that nonuniformity in printing is brought about.

Further, according to the thermal-transfer printer disclosed in JP-A-2-160558, mentioned above, a structure for restraining rattling of the platen roller for pressing a sheet to the thermal head is not disclosed and therefore, there is brought about a drawback of causing rattling in the platen roller in the direction of conveying the sheet. Thereby, also in the thermal-transfer printer disclosed in JP-A-2-160558, mentioned above, similar to the thermal-transfer printer owing to the embodiment of the prior art shown in FIG. 9, there occurs a problem that nonuniformity in printing is brought about owing to the fact that a printing position of the thermal head relative to the sheet is shifted in the direction of conveying the sheet.

Further, according to the thermal-transfer printers disclosed in JP-A-3-049961 and JP-A-9-071022, mentioned above, whereas the structure of restraining a positional shift of the thermal head in a longitudinal direction or the direction along the shaft (direction orthogonal to the direction of conveying the sheet) is disclosed, there is not disclosed a structure for restraining rattling of the thermal head from being brought about in the direction of conveying the sheet. Therefore, also in the thermal-transfer printers disclosed in JP-A-3-049961 and JP-A-9-071022, mentioned above, similar to the thermal-transfer printer according to the example of the prior art shown in FIG. 9, there poses the problem that nonuniformity in printing is brought about owing to the fact that the printing position of the thermal head relative to the sheet is shifted in the direction of conveying the sheet.

SUMMARY OF THE INVENTION

The invention has been conveyed out in order to resolve the above-described problem and it is an object of the invention to provide a thermal-transfer printer capable of restraining nonuiformity in printing from being brought about owing to the fact that a printing position of a thermal head relative to a sheet is shifted in a direction of conveying the sheet.

According to a first aspect of the invention, there is provided a thermal-transfer printer including: a platen roller that conveys a sheet; a thermal head that thermally transfers ink from an ink sheet onto the sheet; a pair of head attaching arms that are made of metal and support the thermal head, the head attaching arms being arranged to extend in a direction along a direction of conveying the sheet and made to be able to deform to bend elastically; and supporting shafts that pivotally supports the pair of head attaching arms, wherein each of the pair of head attaching arms includes: a head attaching portion provided on one end of the head attaching arm for attaching the thermal head; and a supporting shaft attaching portion provided on other end of the head attaching arm, the supporting shaft attaching portion having fitting holes into which the respective supporting shafts are inserted, the fitting holes having center lines being inclined to axis lines of the supporting shafts by a predetermined inclination angle, and being formed by the pair of head attaching arms being bent with bending lines that intersects with lines connecting the fitting holes and a printing position of the thermal head, wherein the supporting shaft attaching portions are attached to the supporting shafts in a state of being elastically bent in directions opposes to each other such that the predetermined inclination angle of the center lines of the fitting holes relative to the axis lines of the supporting shafts are reduced, and wherein a diameter of the respective fitting holes is configured to be such that a width of a region for inserting the supporting shaft in view from a direction of inserting the supporting shaft in a state in which the head attaching arm being not bent, is smaller than a diameter of the supporting shaft.

According to a second aspect of the invention, there is provided a thermal-transfer printer including: a thermal head that thermally transfers ink onto a sheet; a pair of head attaching arms that support the thermal head; and supporting shafts that pivotally supports the pair of head attaching arms, wherein the pair of head attaching arms include supporting shaft attaching portions having fitting holes into which the respective supporting shafts are inserted, the fitting holes having center lines being inclined to axis lines of the supporting shafts by a predetermined inclination angle.

BRIEF DESCRIPTION OF THE DRAWINGS

The above objects and advantages of the present invention will become more apparent by describing preferred exemplary embodiments thereof in detail with reference to the accompanying drawings, wherein.

DETAILED DESCRIPTION OF THE PREFERRED EMBODIMENTS

Referring now to the accompanying drawings, a description will be given in detail of preferred embodiments of the invention.

Figure 1:
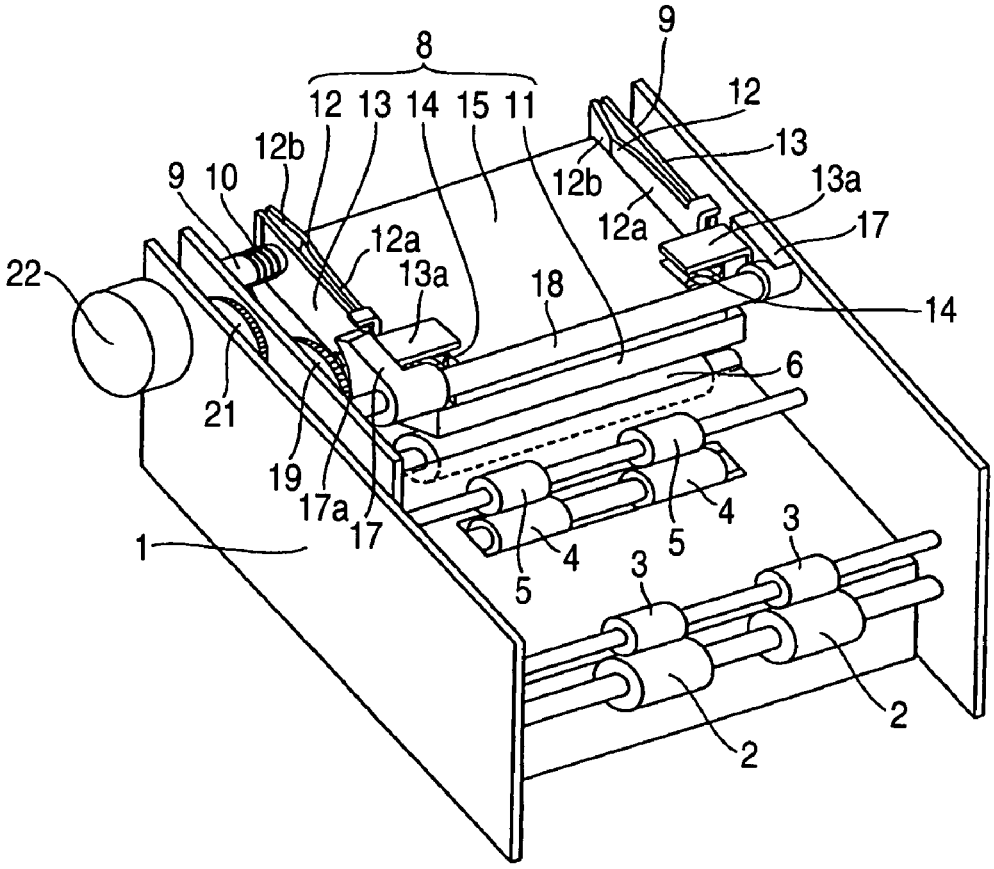
FIG. 1 is a perspective view showing an overall structure of a thermal-transfer printer according to a first embodiment of the invention.
Figure 2:
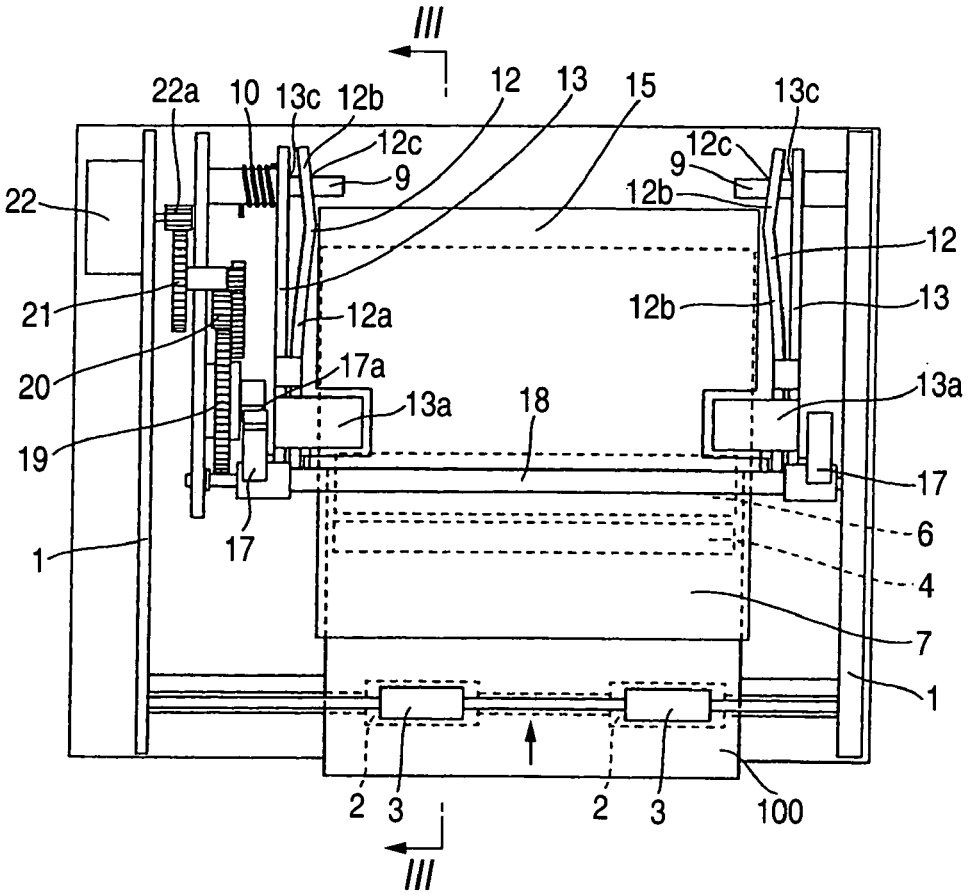
FIG. 2 is a top view of the thermal-transfer printer according to the first embodiment.
Figure 3:
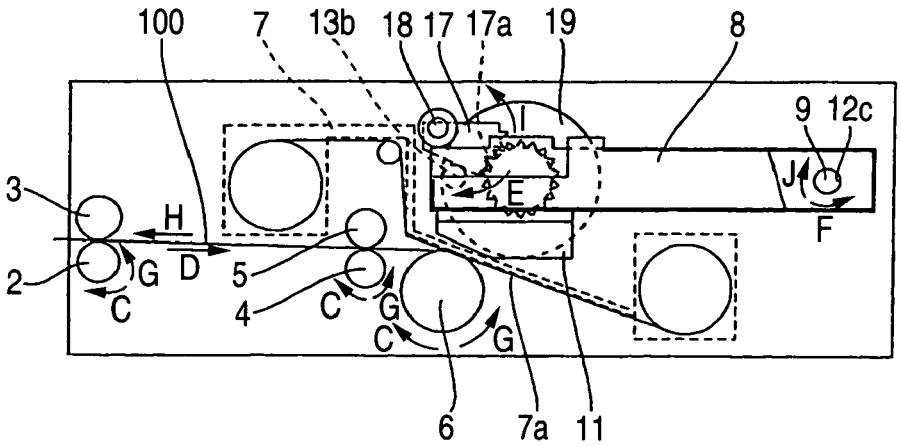
FIG. 3 is a sectional view taken along III—III line shown in FIG. 2.
Figure 4:
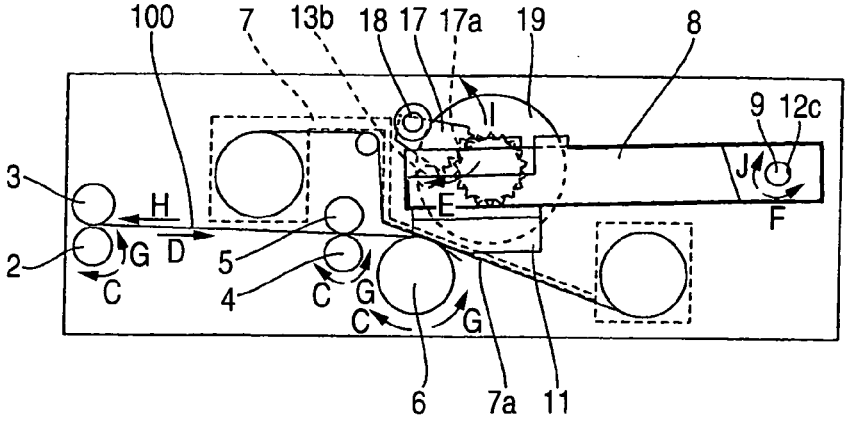
FIG. 4 is a sectional view taken along the III—III line shown in FIG. 2.
Figure 5:
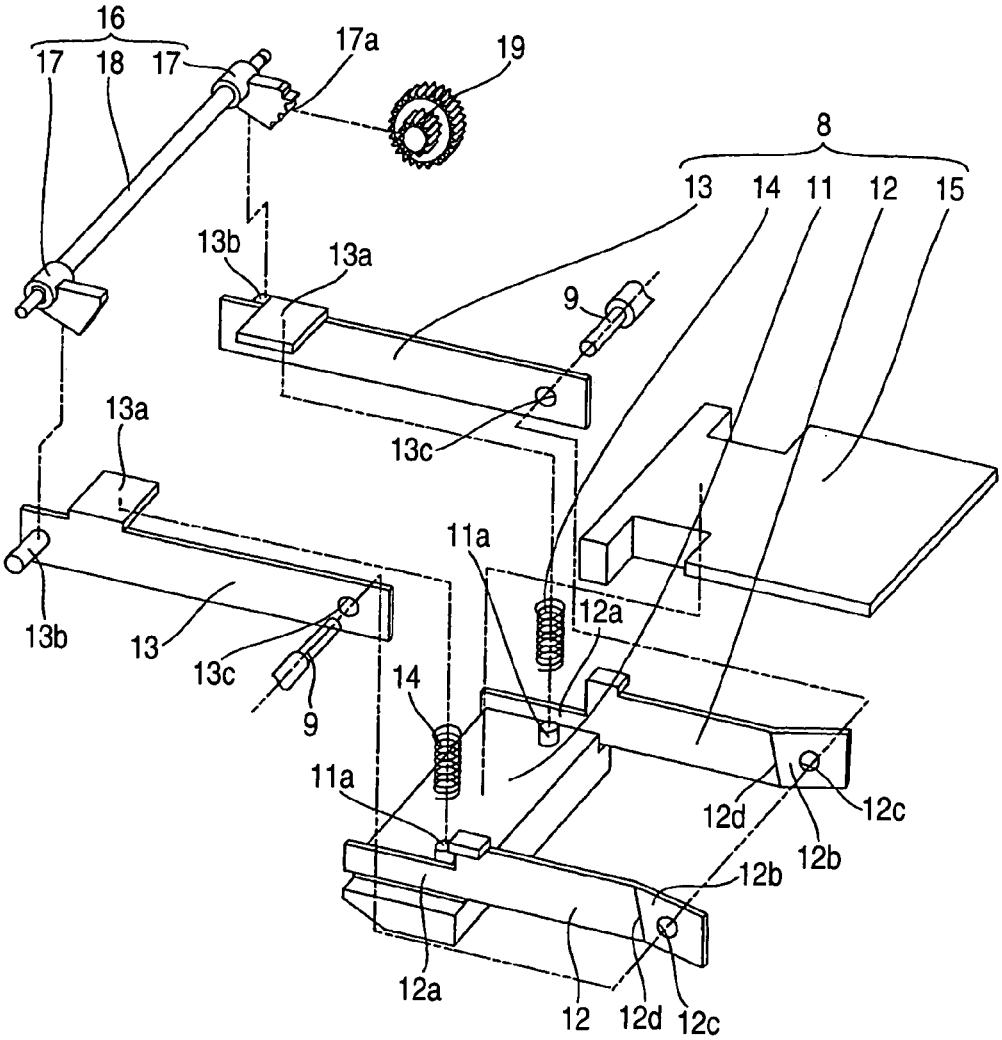
FIG. 5 is a disassembled perspective view showing a structure of a heating portion of the thermal-transfer printer according to the first embodiment.
Figure 6:
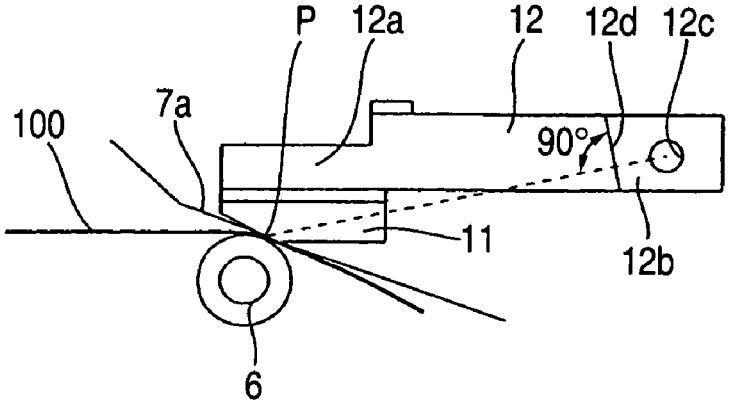
FIG. 6 is a side view of the heating portion of the thermal-transfer printer according to the first embodiment.
Figure 7:
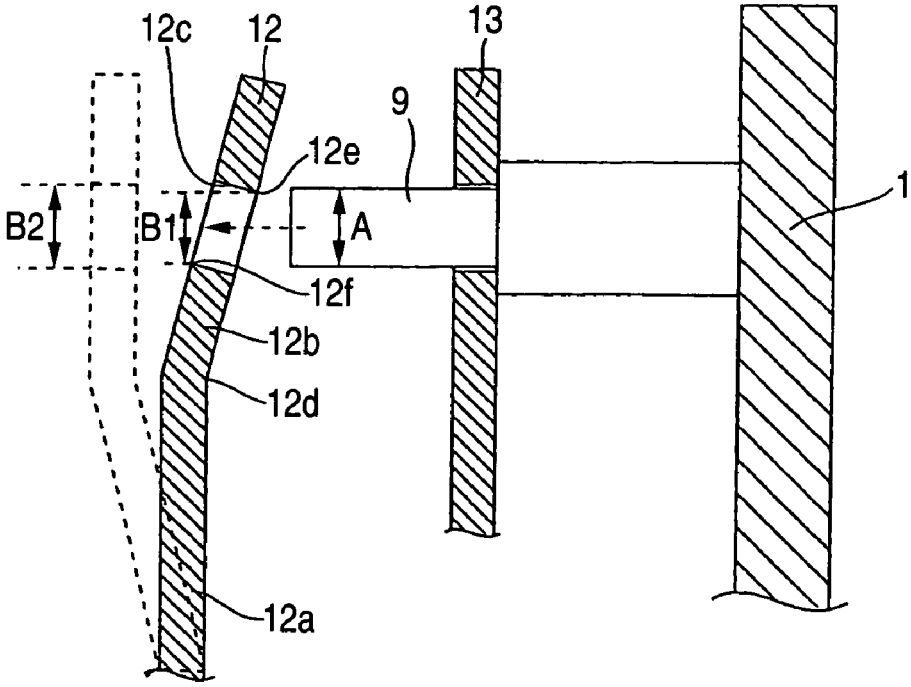
FIG. 7 is an enlarged sectional view showing a structure of attaching a head attaching arm of the thermal-transfer printer according to the first embodiment to a supporting shaft.
Figure 8:
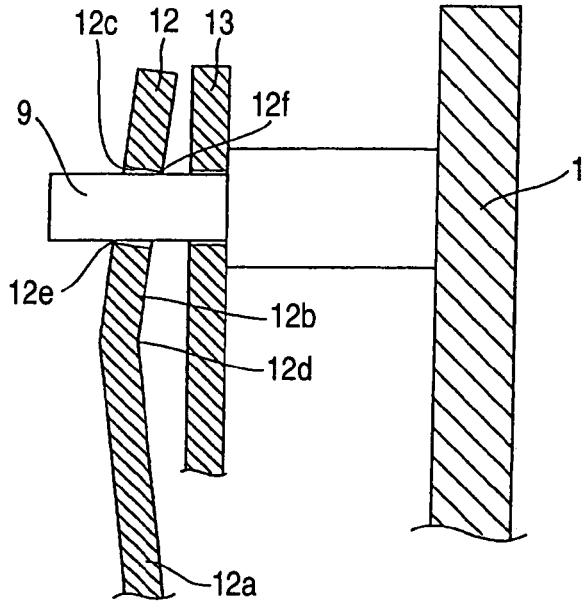
FIG. 8 is an enlarged sectional view showing a structure of attaching a head attaching arm of the thermal-transfer printer according to the first embodiment.
Figure 9:
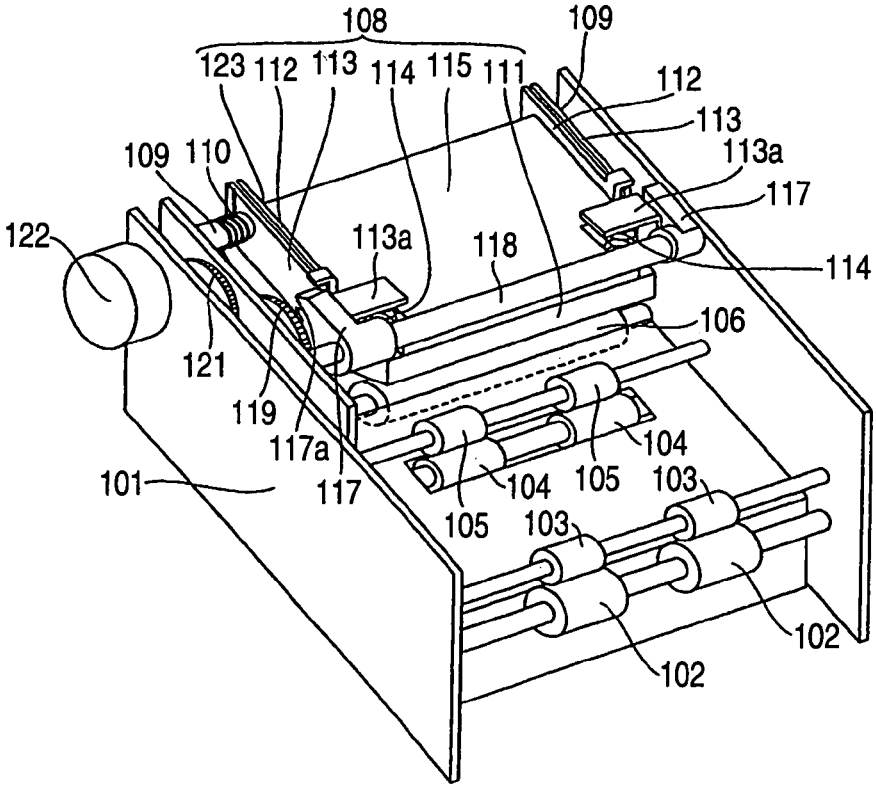
FIG. 9 PRIOR ART
FIG. 9 is a perspective view showing an overall structure of a conventional thermal-transfer printer having a thermal head for thermally transferring ink into a sheet.
Figure 10:
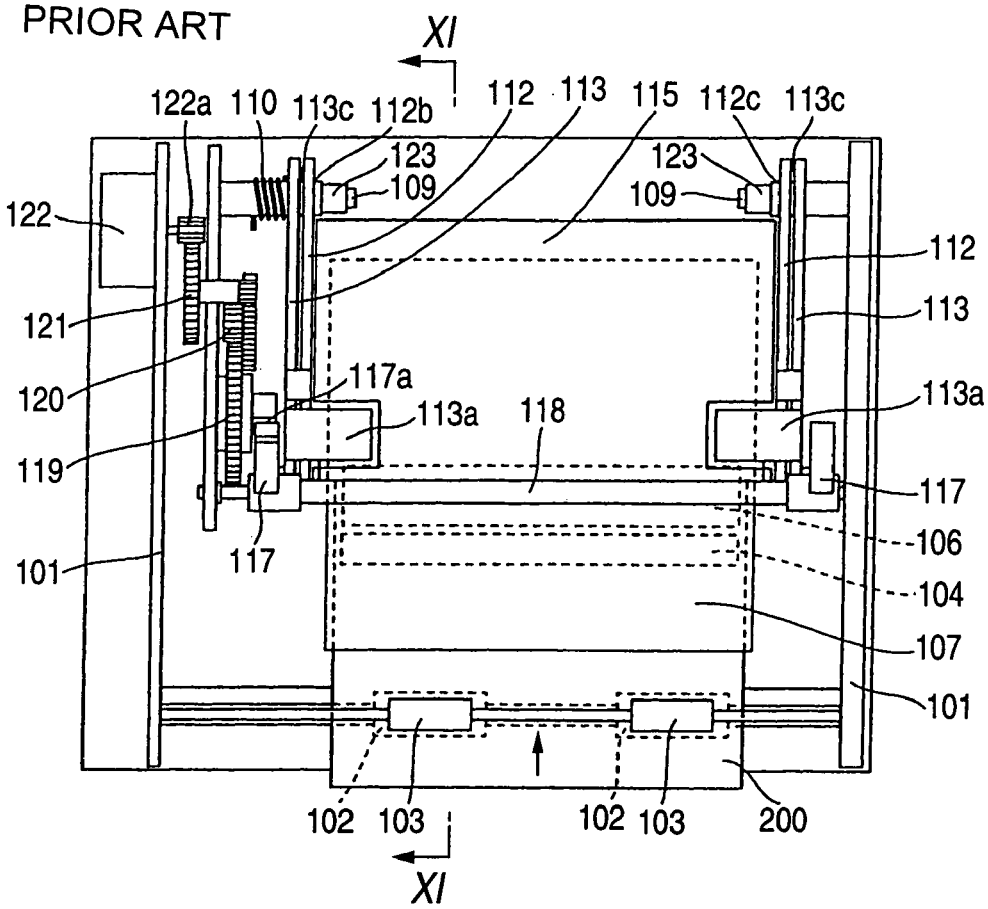
FIG. 10 PRIOR ART
FIG. 10 is a top view of the thermal-transfer printer according to the example shown in FIG. 9.
Figure 11:
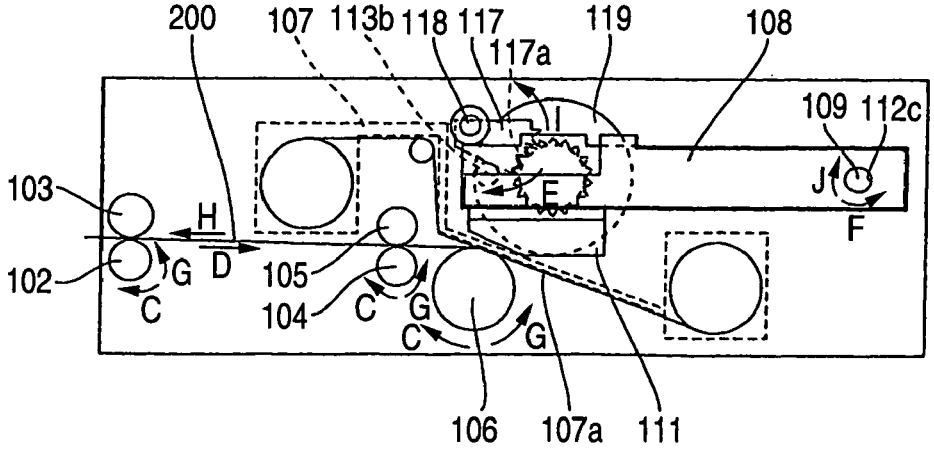
FIG. 11 PRIOR ART
FIG. 11 is a sectional view taken along XI—XI line shown in FIG. 10.
Figure 12:
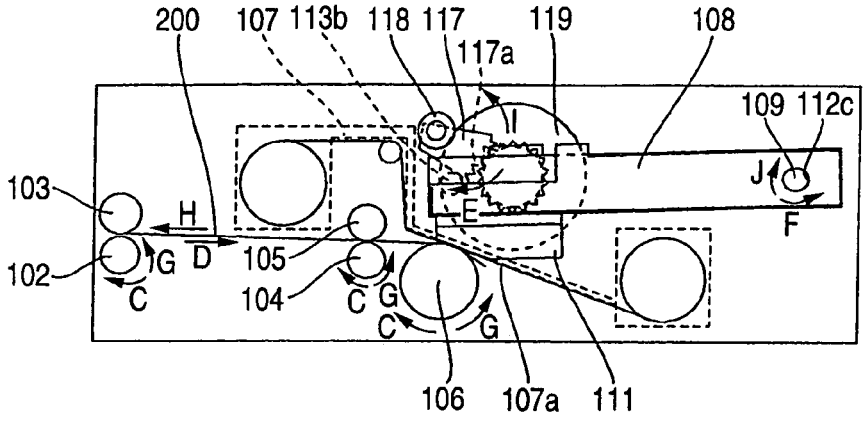
FIG. 12 PRIOR ART
FIG. 12 is a sectional view taken along the XI—XI line shown in FIG. 10.
Figure 13:
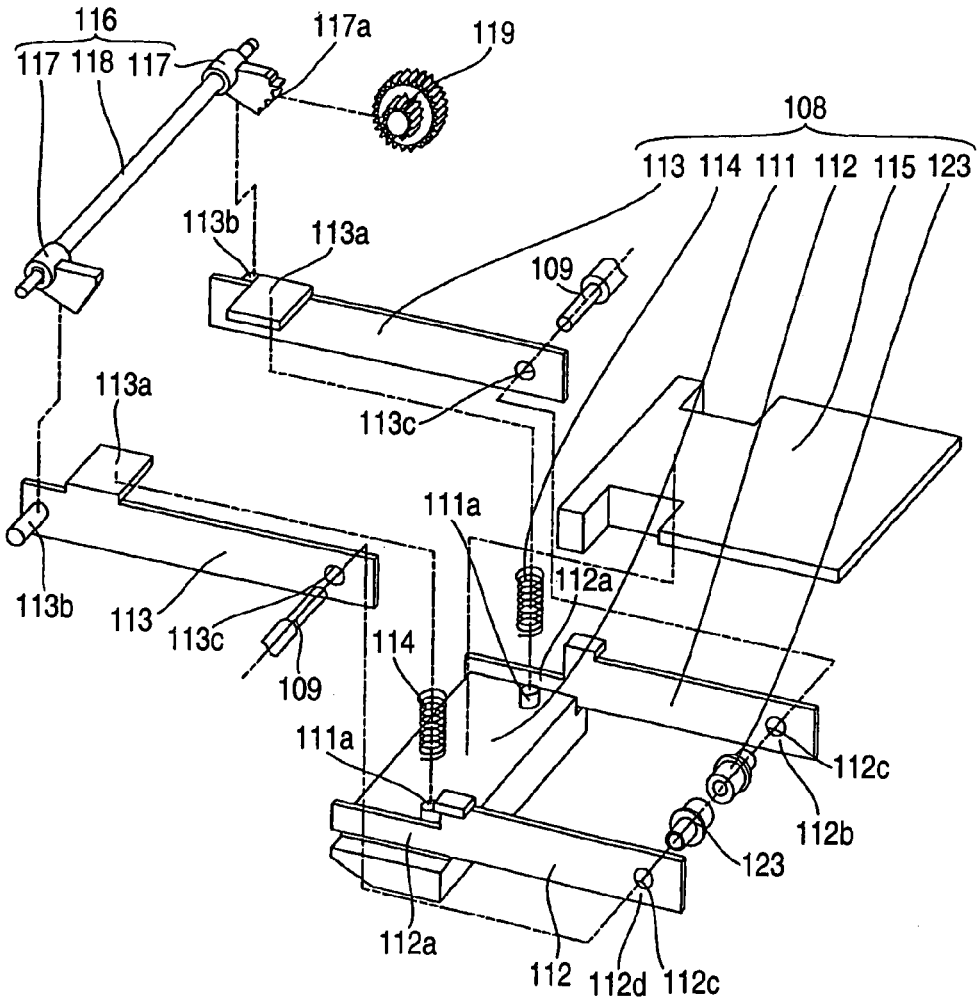
FIG. 13 PRIOR ART
FIG. 13 is a disassembled perspective view showing a structure of a heating portion of the conventional thermal-transfer printer.
Figure 14:
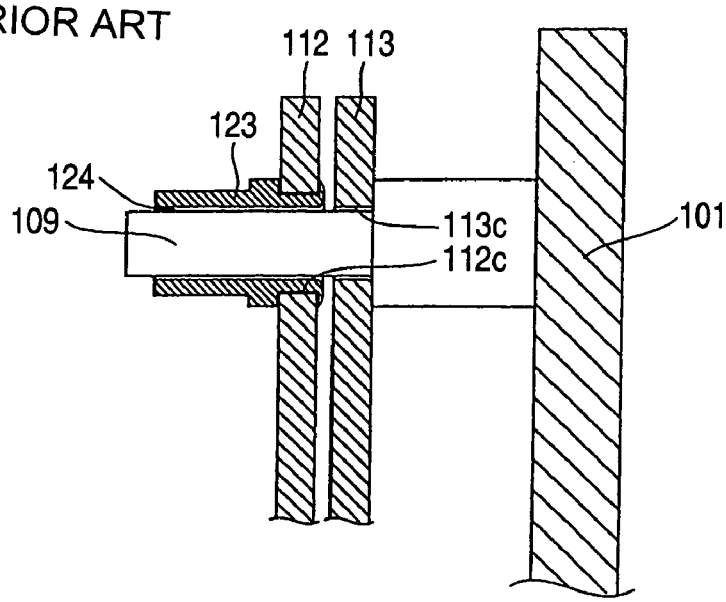
FIG. 14 PRIOR ART
FIG. 14 is an enlarged sectional view showing a structure of attaching a head attaching arm of the conventional thermal-transfer printer shown in FIG. 9 to a supporting shaft.

FIG. 1 is a perspective view showing an overall structure of a thermal-transfer printer according to a first embodiment of the invention. Further, FIG. 1 shows a state of removing an ink cartridge of the thermal-transfer printer. FIG. 2 is a top view of the thermal-transfer printer according to the first embodiment shown in FIG. 1. FIG. 3 and FIG. 4 are sectional views taken along III—III line shown in FIG. 2. FIG. 5 is a disassembled perspective view showing a structure of a heating portion of the thermal-transfer printer according to the first embodiment shown in FIG. 1. FIG. 6 is a side view of the heating portion of the thermal-transfer printer according to the first embodiment shown in FIG. 1. Further, FIG. 6 shows a state of removing a head supporting arm and a compression coil spring of the heating portion. FIG. 7 and FIG. 8 are enlarged sectional views showing a structure of attaching the head attaching arm of the thermal-transfer printer according to the first embodiment shown in FIG. 1 to a supporting shaft. First, an explanation will be given of a structure of the thermal-transfer printer according to the first embodiment of the invention in reference to FIG. 1 through FIG. 8.

As shown in FIG. 1, the thermal-transfer printer according to the first embodiment of the invention is provided with a main body frame 1 made of a metal. A first conveying roller 2 for conveying a sheet 100 (refer to FIG. 2) is provided on this side of a front side of the main body frame 1. A holding roller 3 for restraining the sheet 100 from floating up from the first conveying roller 2 is provided on an upper side of the conveying roller 2. Further, a second conveying roller 4 for conveying the sheet 100 is provided on a rear side of the first conveying roller 2. A holding roller 5 for restraining the sheet 100 from floating up from the second conveying roller 4 is provided on an upper side of the second conveying roller 4.

Further, a platen roller 6 for conveying the sheet 100 is provided on a rear side of the second conveying roller 4. Further, an ink cartridge 7 is attached to a central portion of the main body frame 1 as shown in FIG. 2 through FIG. 4. As shown in FIG. 3, an ink sheet 7*a* adhered with ink for transferring onto the sheet 100 is contained in the ink cartridge 7. The ink of the ink sheet 7*a* is constituted by three colors of inks C (cyan), M (magenta) and Y (yellow).

Further, as shown in FIG. 1 and FIG. 3, a heating portion 8 for thermally transferring the ink of the ink sheet 7*a* onto the sheet 100 (refer to FIG. 2) is provided on a depth side of the central portion of the main body frame 1. The heating portion 8 is pivotally supported by a pair of supporting shafts 9. Further, the heating portion 8 is urged in a direction of pivoting in an upper direction by a torsion coil spring 10 mounted to one of the supporting shafts 9. Further, as shown in FIG. 5, the heating portion 8 is constituted by a thermal head 11, a pair of head attaching arms 12, a pair of head supporting arms 13, a compression coil spring 14 and a heat radiating plate 15. The thermal head 11 is provided for thermally transferring the ink of the ink sheet 7*a* onto the sheet 100 by heating the ink sheet 7*a* contained in the ink cartridge 7 (refer to FIG. 3). Further, as shown in FIG. 5, a pair of spring attaching boss portions 11*a* is provided at an upper portion of the thermal head 11.

The pair of head attaching arms 12 is provided for supporting the thermal head 11. The head attaching arm 12 is formed by a plate member made of a metal having a thickness of about 1 mm. The head attaching arm 12 is provided with a head attaching portion 12*a* and a supporting shaft attaching portion 12*b*. The head attaching arm 12 is made to be able to be elastically bent to deform and is formed to extend in a direction along a direction of conveying the sheet 100 as shown in FIG. 2. As shown in FIG. 5, the thermal head 11 is attached with the head attaching portion 12*a*. The supporting shaft attaching portion 12*b* of the head attaching arm 12 is provided with a fitting hole 12*c* inserted with the supporting shafts 9.

According to the first embodiment, as shown in FIG. 5 and FIG. 6, the supporting shaft attaching portion 12*b* of the head attaching arm 12 is bent in a direction of being proximate to the supporting shaft 9 by approximately 5 degrees through approximately 10 degrees by constituting a fold to bend line 12*d* by a line intersecting with a straight line constituted by connecting a printing portion P brought into contact with the ink sheet 7*a* of the thermal head 11 and the fitting hole 12*c* by an angle of approximately 90 degrees. Thereby, the fitting hole 12*c* provided at the supporting shaft attaching portion 12*b* is formed to extend in the direction of inclining to an axis line of the supporting shafts 9 by an inclination angle of approximately 5 degrees through approximately 10 degrees. Further, as shown in FIG. 7, a diameter of the fitting portion 12*c* is set such that in a state in which the head attaching portion 12*a* of the head attaching arm 12 is not bent, a width of B1 of a region of the fitting hole 12*c* for inserting the supporting shaft 9 in view from the direction of inserting the supporting shaft 9 (broken line arrow mark direction in FIG. 7) becomes smaller than a diameter A of the supporting shaft 9. Specifically, when the diameter A of the supporting shaft 9 is about 3 mm, the diameter of the fitting hole 12*c* is set to about 3.05 mm through about 3.1 mm. Thereby, in the state in which the head attaching portion 12*a* of the head attaching arm 12 is not bent, the supporting shaft 9 cannot be inserted into the fitting hole 12*c*. On the other hand, as shown in a broken line in FIG. 7, when the head attaching portion 12*a* of the head attaching arm 12 is bent in a direction of being remote from the supporting shaft 9, a width B2 of the region of the fitting hole 12*c* for inserting the supporting shaft 9 in view from the direction of inserting the supporting shaft 9 (broken line arrow mark direction in FIG. 7) becomes larger than the diameter A for the supporting shaft 9. Thereby, the supporting shaft 9 can be inserted into the fitting hole 12*c*. Further, as shown in FIG. 8, in a state in which the supporting shaft 9 is inserted into the fitting hole 12*c* of the head attaching arm 12, a peripheral edge portion 12*e* on a front end side of the supporting shaft 9 of the fitting hole 12*c* and a peripheral edge portion 12*f* of the supporting shaft 9 on a side opposed to a front end thereof are respectively brought into contact with two portions of a peripheral face of the supporting shaft 9.

As shown in FIG. 5, the pair of head supporting arms 13 are attached to side faces on outer sides of the head attaching arms 12. The head supporting arm 13 is formed by a plate member made of a metal. A spring pressing portion 13*a* is integrally formed at an upper portion of the head supporting arm 13. A side face of one end portion of the head supporting arms 13 is provided with a boss portion 13*b*. A fitting hole 13*c* is provided at a position of other end portion of the head supporting arm 13 in correspondence with the fitting hole 12*c* of the head attaching arm 12. The supporting shaft 9 is inserted into the fitting hole 13*c* of the head supporting arm 13. Thereby, the head supporting arm 13 is pivotally supported by the supporting shaft 9 along with the head attaching arm 12.

The compression coil spring 14 is mounted to the spring attaching boss portion 11*a* of the thermal head 11. An upper portion of the compression coil spring 14 is pressed by the spring pressing portion 13*a* of the head supporting arm 13. The compression coil spring 14 is provided for pressing the thermal head 11 to a side of the platen roller 6 (refer to FIG. 1) by a predetermined pressing force. Further, as shown in FIG. 5, the heat radiating plate 15 is provided to an upper portion of the thermal head 11. The heat radiating plate 15 is provided for radiating heat of the thermal head 11.

A pressing member 16 is provided to be brought into contact with the respective boss portions 13*b* of the pair of head supporting arms 13. The pressing member 16 is constituted by a pair of pressing arms 17 made of a resin brought into contact with the boss portions 13*b* of the head supporting arm 13 and a connecting member 18 made of a metal for connecting the pair of pressing arms 17. The pressing member arm 16 is constituted to pivot by constituting an axis thereof by the connecting member 18. Further, the pressing member 16 is provided for pivoting the heating portion 8 in a direction of bringing the thermal head 11 into contact with the ink sheet 7*a* (refer to FIG. 3) by pressing down the boss portions of the head supporting arms 13. As shown in FIG. 5, a gear engaging portion 17*a* is formed at one of the pair of pressing arms 17. A drive gear 19 is brought in mesh with the gear engaging portion 17*a* of the pressing arm 17. As shown in FIG. 2, a middle gear 20 is brought in mesh with the drive gear 19 and a drive transmitting gear 21 is brought in mesh with the middle gear 20. A motor side drive gear 22*a* of a motor 22 attached to a side face of the main body frame 11 is brought in mesh with the drive transmitting gear 21.

Next, an explanation will be given of operation of the thermal-transfer printer according to the embodiment in reference to FIG. 2 through FIG. 4 and FIG. 8.

As operation of the thermal-transfer printer according to the embodiment, as shown in FIG. 3, the sheet 100 is conveyed in an arrow mark D direction in FIG. 3 by rotating the first conveying roller 2 in an arrow mark C direction in FIG. 3. The sheet 100 is further conveyed in the arrow mark D direction in FIG. 3 by rotating the second conveying roller 4 in the arrow mark C direction in FIG. 3. The sheet 100 conveyed by the second conveying roller 4 reaches the platen roller 6.

At this occasion, rotation of the motor side drive gear 22*a* rotated by driving the motor 22 (refer to FIG. 2) is transmitted to the gear engaging portion 17*a* of the pressing arm 17 via the drive transmitting gear 21, the middle gear 20 and the drive gear 19. Thereby, the pressing arm 17 is pivoted in an arrow mark E direction in FIG. 3. When the pressing arm 17 is pivoted in the arrow mark E direction in FIG. 3, the boss portion 13*b* of the head supporting arm 13 is pressed down by the pressing arm 17. Thereby, the heating portion 8 disposed at an escaping portion as shown in FIG. 3 is pivoted in an arrow mark F direction in FIG. 3 by constituting an axis thereof by the supporting shaft 9. When the heating portion 8 is pivoted in the arrow mark F direction in FIG. 3, as shown in FIG. 4, the thermal head 11 of the heating portion 8 is brought into contact with the ink sheet 7*a* of the ink cartridge 7 and the ink sheet 7*a* and the sheet 100 are pressed to the platen roller 6. Thereby, the ink sheet 7*a* is heated by the thermal head 11 and therefore, one color of ink in three colors of inks of C (cyan), M (magenta) and Y (yellow) of the ink sheet 7*a* is thermally transcribed onto the sheet 100. At this occasion, the thermal head 11 is exerted with a force in a direction along the direction of conveying the sheet 100 (arrow mark D direction in FIG. 4) from the rotating platen roller 6.

At this occasion, according to the embodiment, as shown in FIG. 8, the peripheral edge portion 12*e* on the front end side of the supporting shaft 9 of the fitting hole 12*c* of the head attaching arm 12 supporting the thermal head 11 and the peripheral edge portion 12*f* on the side opposed to the front end of the support shaft 9 are respectively brought into contact with the two portions of the peripheral face of the supporting shaft 9. Thereby, even when the thermal head 11 (refer to FIG. 4) is exerted with the force in the direction along the direction of conveying the sheet 100 from the platen roller 6, the head attaching arm 12 is not rattled in the direction of conveying the sheet 100 relative to the supporting shaft 9.

The sheet 100 is further conveyed in the arrow mark D direction in FIG. 4 and the ink of the ink sheet 7*a* is thermally transcribed up to a rear end of the sheet 100 by the thermal head 11. When the ink is thermally transcribed up to the rear end of the sheet 100, the sheet 100 is conveyed in an arrow mark H direction in FIG. 4 by rotating the platen roller 6, the second conveying roller 4 and the first conveying roller 2 in an arrow mark G direction in FIG. 4. At this occasion, rotation of the motor side drive gear 22*a* rotated by driving the motor 22 (refer to FIG. 2) is transmitted to the gear engaging portion 17*a* of the pressing arm 17 via the drive transmitting gear 21, the middle gear 20 and the drive gear 19. Thereby, the pressing arm 17 is pivoted in an arrow mark I direction in FIG. 4. In accordance with pivoting the pressing arm 17 in the arrow mark I direction in FIG. 4, the heating portion 8 urged in an upper direction by the torsion coil spring 10 (refer to FIG. 2) is pivoted in an arrow mark J direction in FIG. 4 by constituting an axis thereof by the supporting shaft 9. Thereby, the heating portion 8 is moved to the escaping portion as shown in FIG. 3. Thereby, as shown in FIG. 3, the sheet 100 is conveyed in the arrow mark H direction in FIG. 3 to a vicinity of the first conveying roller 2.

Further, thereafter, by further repeating operation similar to the above-described operation twice, remaining two colors of inks of C (cyan), M (magenta) and Y (yellow) are transcribed onto the sheet 100. Thereby, an image is printed on the sheet 100.

According to the first embodiment, by bending the supporting shaft attaching portion 12*b* of the head attaching arm 12 formed with the fitting hole 12*c* in a direction of being proximate to the supporting shaft 9 by about 5 degrees through about 10 degrees by constituting the fold to bend line 12*d* by the line intersecting with the straight line constituted by connecting the fitting hole 12*c* and the contact point of the thermal head 11 and the ink sheet 7*a* by the angle about 90 degrees, the fitting hole 12*c* can be formed to provide the center line inclined to the axis line of the supporting shaft 9 by the inclination angle of about 5 degrees through about 10 degrees and therefore, the peripheral edge portion 12*e* on the front end side of the supporting shaft 9 of the fitting hole 12*c* and the peripheral edge portion 12*f* on the side opposed to the front end of the supporting shaft 9 can respectively be brought into contact with the two portions of the peripheral face of the supporting shaft 9. Thereby, even when an inner diameter of the fitting hole 12*c* is larger than an outer diameter of the supporting shaft 9, a clearance can be restrained from being produced between the supporting shaft 9 and the fitting hole 12*c* of the attaching arm 12 and therefore, the head attaching arm 12 can be restrained from being rattled relative to the supporting shaft 9. Therefore, the thermal head 11 attached to the head attaching arm 12 can be restrained from being positionally shifted in the direction of conveying the sheet 100 and therefore, nonuniformity in printing can be restrained from being brought about owing to the fact that the printing portion of the thermal head 11 relative to the sheet 100 is shifted in the direction of conveying the sheet 100.

Further, according to the first embodiment, by attaching the fitting hole 12*c* of the supporting shaft attaching portion 12*b* of the head attaching arm 12 inclined to the axis line of the supporting shaft 9 by the inclination angle of about 5 degrees through about 10 degrees to the supporting shaft 9, the head attaching arm 12 can pivotally be supported by the supporting shaft 9 without providing a bearing member between the fitting hole 12*c* of the head attaching arm 12 and the supporting shaft 9. Thereby, in comparison with the case of providing the bearing member between the fitting hole and the supporting shaft, a number of parts can be reduced by an amount of the bearing member.

Further, according to the first embodiment, by attaching the fitting hole 12*c* of the head attaching arm 12 to the supporting shaft 9 in a state of elastically bending the head attaching arm 12 in a direction of reducing the inclination angle of the fitting hole 12*c* relative to the axis line of the supporting shaft 9, even when there is a clearance between the supporting shaft 9 and the fitting hole 12*c* in a state in which the head attaching arm 12 is not bent, by recovering deformation of the elastically bent head attaching arm 12 up to a position at which the peripheral edge portions 12*e* and 12*f* of the fitting hole 12*c* are brought into contact with the peripheral face of the supporting shaft 9, the peripheral edge portion 12*e* on the front end side of the supporting shaft 9 of the fitting hole 12*c* and the peripheral edge portion 12*f* on the side opposed to the front end of the supporting shaft 9 can respectively be brought into contact with the two portions of the peripheral face of the supporting shaft 9. Thereby, even when there is a clearance between the supporting shaft 9 and the fitting hole 12*c* in the state in which the head attaching arm 12 is not bent, the head attaching arm 12 can be restrained from rattling relative to the supporting shaft 9.

Further, according to the first embodiment, by setting the diameter of the fitting hole 12*c* such that the width of the region of the fitting hole 12*c* for inserting the supporting shaft 9 in view from the direction of inserting the supporting shaft 9 becomes smaller than the diameter of the supporting shaft 9 in the state in which the head attaching arm 12 is not bent, the width of the region of the fitting hole 12*c* for inserting the supporting shaft 9 in view from the direction of inserting the supporting shaft 9 is increased by bending the head attaching arm 12 in the direction of reducing the inclination angle of the fitting hole 12*c* relative to the axis line direction of the supporting shaft 9 and therefore, the supporting shaft 9 can be inserted into the fitting hole 12*c*. Meanwhile, after inserting the supporting shaft 9 into the fitting hole 12*c*, the inclination angle of the fitting hole 12*c* relative to the axis line direction of the supporting shaft 9 is increased by recovering the deformation of the bent head attaching arm 12 and therefore, the width of the region of the fitting hole 12*c* for inserting shaft 9 in view from the direction of inserting the supporting shaft 9 is reduced. Thereby, the peripheral edge portion 12*e* on the front end side of the supporting shaft 9 of the fitting hole 12*c* and the peripheral edge portion 12*f* on the side opposed to the front end of the supporting shaft 9 can respectively be brought into contact with the two locations of the peripheral face of the supporting shaft 9. Therefore, rattling can be restrained from being brought about between the fitting hole 12*c* of the head attaching arm 12 and the supporting shaft 9.

he first embodiment is shown as an exemplification in all the respects and is not to be limited as restrictive. A range of the invention is shown not by the above-described explanation of the embodiment but by the scope of claims and includes a significance equivalent to the scope of claims and all the modifications within the range.

For example, although according to the first embodiment, the fitting hole 12*c* provided at the supporting shaft attaching portion 10*b* is formed to provide the center line inclined to the axis line of the supporting shaft 9 by bending the supporting shaft attaching portion 12*b* of the head attaching arm 12, the invention is not limited to thereto but the fitting hole 12*c* may be formed to provide the center line inclined to the axis line of the supporting shafts 9 without bending the head attaching arm 12. For example, by forming a fitting hole in a direction skewedly intersecting with a head attaching arm formed to extend linearly, the fitting hole may be formed to provide the center line inclined to the axis line of the supporting shaft.

Further, although according to the first embodiment, the head attaching arm 12 is attached to the supporting shaft 9 in the state of elastically bending the head attaching arm 12 in the direction of reducing the inclination angle relative to the axis line of the supporting shaft 9 of the fitting hole 12*c*, the invention is not limited thereto but the head attaching arm may be attached to the supporting shaft without being bent.

Although according to the first embodiment described above, the supporting shaft attaching portion 12*b* of the head attaching arm 12 is bent by constituting the fold to bent line 12*d* by the line intersecting with the straight line constituted by connecting the fitting hole 12*c* and the printing portion P and the thermal head 11 relative to the sheet 100 by the angle of about 90 degrees, the invention is not limited thereto but the supporting shaft attaching portion may be bent by constituting the fold to bend line by a line intersecting with the straight line constituted by connecting the fitting hole and the printing position of the thermal head relative to the sheet by an angle other than about 90 degrees.

Figure 15:
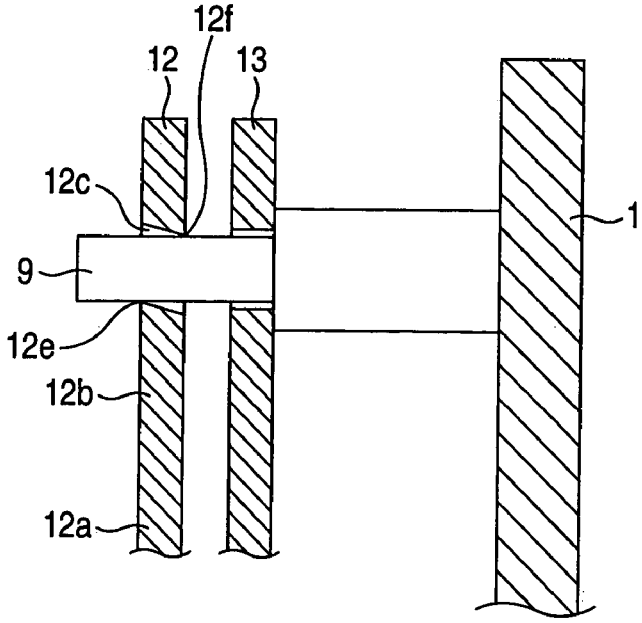
FIG. 15 is an enlarged sectional view showing a structure of attaching a head attaching arm of the thermal-transfer printer according to a first embodiment.

In the first embodiment, as shown in FIGS. 7 and 8, the peripheral edge portions 12*e* and 12*f* are respectively brought into contact with the two portions of the peripheral face of the supporting shaft 9 by elastically bending the supporting shaft attaching portion 12*b*. However, as shown in FIG. 15, the supporting shaft attaching portion 12*b* may be formed straight (not bent) and the fitting hole 12*c* being formed to be inclined with respect to the supporting shaft attaching portion 12*b* (second embodiment). Accordingly, as shown in FIG. 15, the peripheral edge portions 12*e* and 12*f* of the supporting shaft attaching portion 12*b* become respectively brought into contact with two portions of a peripheral face of the supporting shaft 9.

According to a first aspect of the invention, by forming the fitting hole for inserting the supporting shaft to include the center line inclined by the predetermined inclination angle to the axis line of the supporting shaft at the supporting shaft attaching portion of the head attaching arm, and bending the supporting shaft attaching portion to constitute the fold to bend line by the line intersecting with the straight line constituted by connecting the fitting hole and the contact point of the thermal head and the ink sheet, a peripheral edge portion on a front end side of the fitting hole of the supporting shaft attaching portion and a peripheral edge portion on a side opposed to the front end of the supporting shaft can respectively be brought into contact with two portions of a peripheral face of the supporting shaft. Thereby, even when an inner diameter of the fitting hole is larger than an outer diameter of the supporting shaft, a clearance can be restrained from being produced between the supporting shaft and the fitting hole of the head attaching arm and therefore, the head attaching arm can be restrained from being rattled relative to the supporting shaft. Therefore, the thermal head attached to the head attaching arm can be restrained from being positionally shifted in the direction of conveying the sheet and therefore, nonuniformity of printing can be restrained from being brought about owing to the fact that a printing position of the thermal head relative the sheet is shifted in the direction of conveying the sheet. Further, by attaching the fitting hole of the supporting shaft attaching portion of the head attaching arm inclined to the axis line of the supporting shaft to the supporting shaft, the head attaching arm can pivotally be supported by the supporting shaft without providing a bearing member between the fitting hole of the head attaching arm and the supporting shaft. Thereby, in comparison with a case of providing a bearing member between the fitting hole and the supporting shaft, a number of parts can be reduced by an amount of the bearing member. Further, by attaching the fitting hole of the head attaching arm to the supporting shaft in the state of elastically bending the head attaching arm in the direction of reducing the inclination angle relative to the axis line of the supporting shaft, even when there is a clearance between the supporting shaft and the fitting hole in the state in which the head attaching arm is not bent, by recovering deformation of the head attaching arm bent elastically up to a position at which the peripheral edge portion of the fitting hole is brought into contact with the peripheral face of the supporting shaft, the peripheral edge portion on the front end side of the supporting shaft of the supporting fitting hole and the peripheral edge portion on the side opposed to the front end supporting shaft can respectively be brought into contact with two portions of the peripheral face of the supporting shaft. Thereby, even when there is a clearance between the supporting shaft and the fitting hole in the state in which the head attaching arm is not bent, the head attaching arm can be restrained from rattling relative to the supporting shaft.

Further, by setting the diameter of the fitting hole such that the width of the region of the fitting hole for inserting the supporting shaft in view from the direction of inserting the supporting shaft in the state in which the head attaching arm is not bent, the width of the region of the fitting hole for inserting the supporting shaft in view from the direction of inserting the supporting shaft is increased by bending the head attaching arm in the direction of reducing the predetermined inclination angle of the fitting hole relative to the axis line direction of the supporting shaft and therefore, the supporting shaft can be inserted into the fitting hole. Meanwhile, after inserting supporting shaft into the fitting hole, the predetermined inclination angle of the fitting hole relative to the axis line direction of the supporting shaft is increased by recovering deformation of the bent head attaching arm and therefore, the width of the region of the fitting hole for inserting the supporting shaft in view from the direction of inserting the supporting shaft is reduced. Thereby, the peripheral edge portion of the fitting hole on the front end side of the supporting shaft and the peripheral edge portion on the side opposed to the front end of the supporting shaft can respectively be brought into contact with the two portions of the peripheral face of the supporting shaft. Therefore, rattling can be restrained from being brought about between the fitting hole of the head attaching arm and supporting shaft.

According to a second aspect of the invention, by forming the fitting hole for inserting the supporting shaft to include the center line inclined to the axis line of the supporting shaft by the predetermined inclination angle at the supporting shaft attaching portion of the head attaching arm, when the supporting shaft is inserted into the fitting hole, the peripheral edge portion of the fitting hole on the front end side of the supporting shaft and the peripheral edge portion on the side opposed to the front end of the supporting shaft can respectively be brought into contact with two portions of the peripheral face of the supporting shaft. Thereby, even when the inner diameter of the fitting hole is larger than the outer diameter of the supporting shaft, a clearance can be restrained from being produced between the supporting shaft and the fitting hole of the attaching arm and therefore, the head attaching arm can be restrained from being rattled relative to the supporting shaft. Therefore, the thermal head attached to the head attaching arm can be restrained from being positionally shifted in the direction of conveying the sheet and therefore, nonuniformity of printing can be restrained from being brought about owing to the fact that the printing position of the thermal head relative to the sheet is shifted in the direction of conveying the sheet. Further, by attaching the fitting hole of the supporting shaft attaching portion of the head attaching arm inclined to the axis line of the supporting shaft to the supporting shaft, the head attaching arm can pivotally be supported by the supporting shaft without providing a bearing member between the fitting hole of the head attaching arm and the supporting shaft. Thereby, in comparison with the case of providing the bearing member between the fitting hole and the supporting shaft, a number of parts can be reduced by an amount of the bearing member.

In the pair of head attaching arms, it is preferable to attach the respective supporting shaft attaching portions to the supporting shafts in a state of being elastically bent in directions opposed to each other such that a predetermined inclination angle of the center lines of the fitting holes relative to the axis lines of the supporting shafts are reduced. When configured in this way, even when there is a clearance between the supporting shaft and the fitting hole in the state in which the head attaching arm is not bent, by recovering deformation of the elastically bent at attaching arm up to a position at which the peripheral edge portion of the fitting hole is brought into contact with a peripheral face of the supporting shaft, the peripheral edge portion of the fitting hole on the front end side of the supporting shaft and the peripheral edge portion on the side opposed to the front end of the supporting shaft can respectively be brought into contact with two portions of the peripheral face of the supporting shaft. Thereby, even when there is the clearance between supporting shaft and the fitting hole in the state in which the head attaching arm is not bent, the head attaching arm can be restrained from rattling relative to the supporting shaft.

The supporting shaft attaching portions of the pair of head attaching arms are preferable to be bent by constituting fold to bending lines by lines intersecting with straight lines constituted by connecting the fitting holes and a printing position of the thermal head relative to the sheet. When configured in this way, the fitting hole for inserting the supporting shaft can easily be formed to provide the center line inclined to the axis line of the supporting shaft by the predetermined inclined angle and therefore, the peripheral edge portion of the fitting hole on the front end side of the supporting shaft and the peripheral edge portion on the side opposed to the front end of the supporting shaft can respectively be brought into contact with two portions of the peripheral face of the supporting shaft. Thereby, the head attaching arm can easily be restrained from rattling relative to the supporting shaft.

A diameter of the fitting hole formed at the bent supporting shaft attaching portion is preferable to be set such that a width of a region for inserting the supporting shaft in view from a direction of inserting the supporting shaft is smaller than a diameter of the supporting shaft in a state in which the head attaching arm is not bent. When configured in this way, by bending the head attaching arm in the direction of reducing the predetermined inclination angle relative to the axis line direction of the supporting shaft, the width of the region for inserting the supporting shaft of the fitting hole in view from the direction of inserting the supporting shaft is increased and therefore, the supporting shaft can be inserted into the fitting hole. Meanwhile, after inserting the supporting shaft into the fitting hole, by recovering deformation of the bent head attaching arm, a predetermined inclination angle of the fitting hole relative to the axis line direction of the supporting shaft is increased and therefore, the width of the region for inserting the supporting shaft of the supporting hole in view from the direction of inserting the supporting shaft is reduced. Thereby, the peripheral edge portion of the fitting hole on the front end side of the supporting shaft and the peripheral edge portion on the side opposed to the front end of the supporting shaft can respectively be brought into contact with two portions of the peripheral face of the supporting shaft. Therefore, rattling can be restrained from being brought about between the fitting hole of the head attaching arm and the supporting shaft.

Although the present invention has been shown and described with reference to a specific preferred embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. A thermal-transfer printer comprising:

a platen roller that conveys a sheet;

a thermal head that thermally transfers ink from an ink sheet onto the sheet;

a pair of head attaching arms that are made of metal and support the thermal head, the head attaching arms being arranged to extend in a direction along a direction of conveying the sheet and made to be able to deform to bend elastically; and supporting shafts that pivotally support the pair of head attaching arms, wherein each of the pair of head attaching arms includes:

a head attaching portion provided on one end of the head attaching arm for attaching the thermal head; and a supporting shaft attaching portion provided on other end of the head attaching arm, the supporting shaft attaching portion having fitting holes into which the respective supporting shafts are inserted, the fitting holes having center lines being inclined to axis lines of the supporting shafts by a predetermined inclination angle, and being formed by the pair of head attaching arms being bent with bending lines that intersect with lines connecting the fitting holes and a printing position of the thermal head, wherein the supporting shaft attaching portions are attached to the supporting shafts in a state of being elastically bent in directions opposed to each other such that the predetermined inclination angle of the center lines of the fitting holes relative to the axis lines of the supporting shafts are reduced, and wherein a diameter of the respective fitting holes is configured to be such that a width of a region for inserting the supporting shaft in view from a direction of inserting the supporting shaft in a state in which the head attaching arm being not bent, is smaller than a diameter of the supporting shaft.

2. A thermal-transfer printer comprising:

a thermal head that thermally transfers ink onto a sheet;

a pair of head attaching arms that support the thermal head; and supporting shafts that pivotally support the pair of head attaching arms, wherein the pair of head attaching arms include supporting shaft attaching portions having fitting holes into which the respective supporting shafts are inserted, the fitting holes having center lines being inclined to axis lines of the supporting shafts by a predetermined inclination angle when the pair of head attaching arms are mounted onto the respective supporting shafts.

3. The thermal-transfer printer according to claim 2, wherein the supporting shaft attaching portions are attached to the supporting shafts in a state of being elastically bent in directions opposed to each other such that the predetermined inclination angle of the center lines of the fitting holes relative to the axis lines of the supporting shafts are reduced.

4. The thermal-transfer printer according to claim 2, wherein the supporting shaft attaching portions are formed by the pair of head attaching arms being bent with bending lines that intersect with lines connecting the fitting holes and a printing position of the thermal head.

5. The thermal-transfer printer according to claim 2, wherein a diameter of the respective fitting holes is configured to be such that a width of a region for inserting the supporting shaft in view from a direction of inserting the supporting shaft in a state in which the head attaching arm being not bent, is smaller than a diameter of the supporting shaft.

6. The thermal-transfer printer according to claim 2 further comprising a platen roller that conveys the sheet.

7. The thermal-transfer printer according to claim 2, wherein the thermal head thermally transfers ink from an ink sheet onto the sheet.

8. The thermal-transfer printer according to claim 2, wherein the head attaching arms are made of metal.

9. The thermal-transfer printer according to claim 2, wherein the supporting shafts are formed in a cylindrical shape.

* * * * *